US010811198B2

(12) United States Patent
Shinohara et al.

(10) Patent No.: US 10,811,198 B2
(45) Date of Patent: Oct. 20, 2020

(54) SWITCH

(71) Applicant: Omron Corporation, Kyoto (JP)

(72) Inventors: Kenji Shinohara, Kyoto (JP); Hiroyuki Fujita, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/490,125

(22) PCT Filed: Dec. 13, 2017

(86) PCT No.: PCT/JP2017/044726
§ 371 (c)(1),
(2) Date: Aug. 30, 2019

(87) PCT Pub. No.: WO2018/168130
PCT Pub. Date: Sep. 20, 2018

(65) Prior Publication Data

US 2019/0393000 A1 Dec. 26, 2019

(30) Foreign Application Priority Data

Mar. 13, 2017 (JP) ..... 2017-047767

(51) Int. Cl.
*H01H 1/12* (2006.01)
*H01H 13/18* (2006.01)

(52) U.S. Cl.
CPC ..... *H01H 1/12* (2013.01); *H01H 13/186* (2013.01); *H01H 2205/002* (2013.01)

(58) Field of Classification Search
CPC ..... H01H 1/12; H01H 1/42; H01H 3/122; H01H 13/14; H01H 13/186; H01H 13/24;
(Continued)

(56) References Cited

U.S. PATENT DOCUMENTS 8,124,896 B2 * 2/2012 Ruff ..... H01H 1/36 200/252
8,796,574 B2 * 8/2014 Kishi ..... H01H 13/42 200/467

(Continued)

FOREIGN PATENT DOCUMENTS

JP S57-140122 U 9/1982
JP 2014-182956 A 9/2014
JP 2015-162436 A 9/2015

OTHER PUBLICATIONS

International Search Report issued in Application No. PCT/JP2017/044726, dated Mar. 20, 2018 (1 page).

(Continued)

*Primary Examiner* — William A Bolton
(74) *Attorney, Agent, or Firm* — Osha Liang LLP

(57) ABSTRACT

A switch includes a base, a fixed contact member having fixed contact, and a movable contact member having a movable contact. The movable contact member moves in a first direction to bring the movable contact into contact with the fixed contact, and moves in a second direction opposite to the first direction to separate the movable contact from the fixed contact. The switch further includes a cover, an elastic body that energizes the movable contact member in the second direction, and an operation body configured to move the movable contact member sequentially to a first position, a second position, and a third position.

5 Claims, 12 Drawing Sheets

(58) Field of Classification Search
CPC ... H01H 13/36; H01H 13/38; H01H 2205/002
USPC ..... 200/238, 252, 276.1, 284, 530, 536, 467
See application file for complete search history.

(56) References Cited

U.S. PATENT DOCUMENTS

| | | | | |
|---|---|---|---|---|
| 2013/0256104 | A1* | 10/2013 | Fujita | H01H 1/36 200/252 |
| 2014/0284195 | A1 | 9/2014 | Fujita et al. | |
| 2014/0346026 | A1* | 11/2014 | Sakashita | H01H 3/22 200/518 |
| 2015/0206670 | A1* | 7/2015 | Shiraishi | H01H 13/10 200/402 |
| 2017/0011872 | A1 | 1/2017 | Shinohara et al. | |
| 2017/0125189 | A1* | 5/2017 | Domzalski | H01H 13/52 |

OTHER PUBLICATIONS

Written Opinion issued in International Application No. PCT/JP2017/044726, dated Mar. 20, 2018 (6 pages).

* cited by examiner

SWITCH

TECHNICAL FIELD

The present disclosure relates to a switch.

BACKGROUND ART

Patent Documents 1 and 2 each disclose a switch that opens and closes contact by operating a lever to cause a slider (hereinafter referred to as a movable contact member) to operate via a pressing member.

PRIOR ART DOCUMENTS

Patent Documents

Patent Document 1: Japanese Unexamined Patent Publication No. 2014-182956

Patent Document 2: Japanese Unexamined Patent Publication No. 2015-162436

SUMMARY OF THE INVENTION

Problems to be Solved by the Invention

Generally, in a switch, in order to move the movable contact member smoothly, grease is applied between the movable contact member and a fixed contact portion or the like to slide (hereinafter referred to as a fixed contact member). Abrasion powder generated at the time of contact switching may be mixed into the grease to increase viscosity. In addition, the grease is likely to be accumulated at a movement final end of the movable contact member due to the repeated movement of the movable contact member.

Meanwhile, in the switch, the movable contact member is only moved to a position where the contacts come in contact and then moved in the opposite direction. For this reason, if grease is accumulated on the side of a position where the contacts come into contact, the grease adheres to the movable contact member having moved to this position and is pulled at the time of moving in the opposite direction. A grease layer with increased thickness then spreads on the fixed contact member. This grease layer also spreads due to the wettability of the grease itself. As a result, the movable contact member might ride on the thick grease layer to impair the contact reliability of the contacts.

An object of the present disclosure is to provide a switch capable of ensuring the contact reliability of a contact by moving the movable contact member to a position away from grease accumulation even if the grease accumulation occurs.

Means for Solving the Problem

As means for solving the above problems, the present disclosure provides a switch including: a base; a fixed contact member having a fixed contact and provided on the base; a movable contact member having a movable contact and configured to bring the movable contact into contact with the fixed contact by moving in a first direction, the movable contact member being configured to separate the movable contact from the fixed contact by moving in a second direction opposite to the first direction; an elastic body configured to energize the movable contact member in the second direction; a cover attached to the base and configured to cover the fixed contact member and the movable contact member; and an operation body attached to the cover and configured to move the movable contact member. The operation body is configured to move the movable contact member sequentially to a first position to which the movable contact member is moved from an initial position in the first direction to bring the movable contact into contact with the fixed contact, a second position to which the movable contact member is moved from the first position in the second direction while the movable contact and the fixed contact are kept in contact, and a third position to which the movable contact member is moved again from the second position in the first direction, the third position located between the first position and the second position.

Effect of the Invention

According to the present disclosure, only by causing the operation body to move the movable contact member in the order of the first position, the second position, and the third position, it is possible to immediately return the movable contact member from the first position, where the movable contact member has moved in the first direction the most, to the second position on the side opposite to the first position. For this reason, even if grease accumulation occurs and abrasion powder accompanying the contact switching is mixed to increase the viscosity and if the grease accumulation spreads due to the pulling of the movable contact member or its own wettability, the contact reliability of the contacts is not impaired since the movable contact member has been moved from the first position to the second position.

MODE FOR CARRYING OUT THE INVENTION

Hereinafter, an embodiment of the present disclosure will be described with reference to the accompanying drawings. In the following description, terms indicating specific directions or positions (e.g., terms including "upper", "lower", "side", and "end") are used as necessary, but the use of these terms is for facilitating the understanding of the invention with reference to the drawings, and the technical scope of the present disclosure is not limited by the meaning of these terms. The following description is merely exemplary in nature and not intended to limit the present disclosure, its application, or its usage. Further, the drawings are schematic, and a ratio and the like of each dimension do not necessarily agree with actual ones.

First Embodiment

Figure 1:
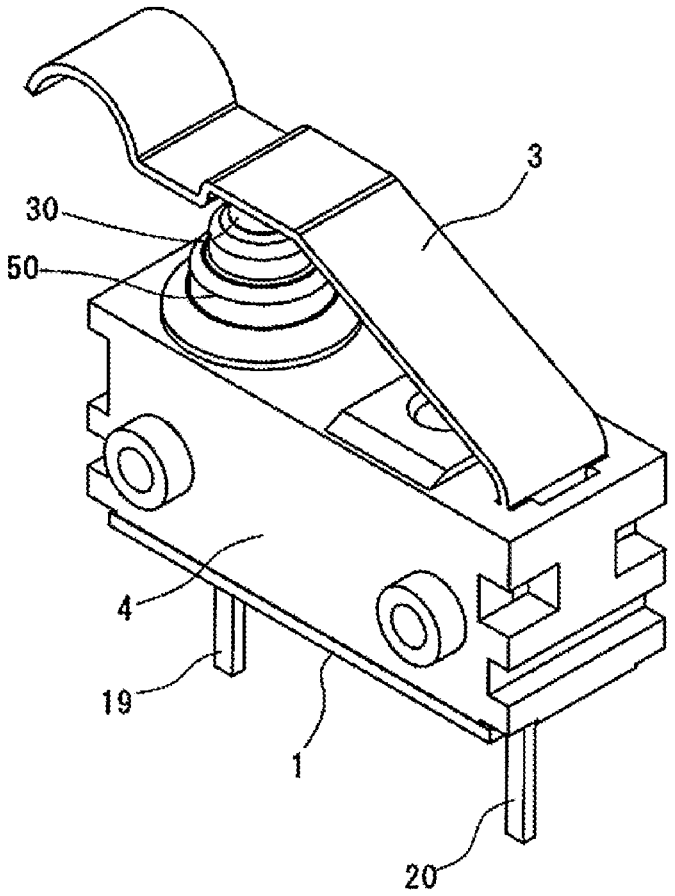
FIG. 1 illustrates a perspective view of a switch according to a first embodiment.
Figure 2:
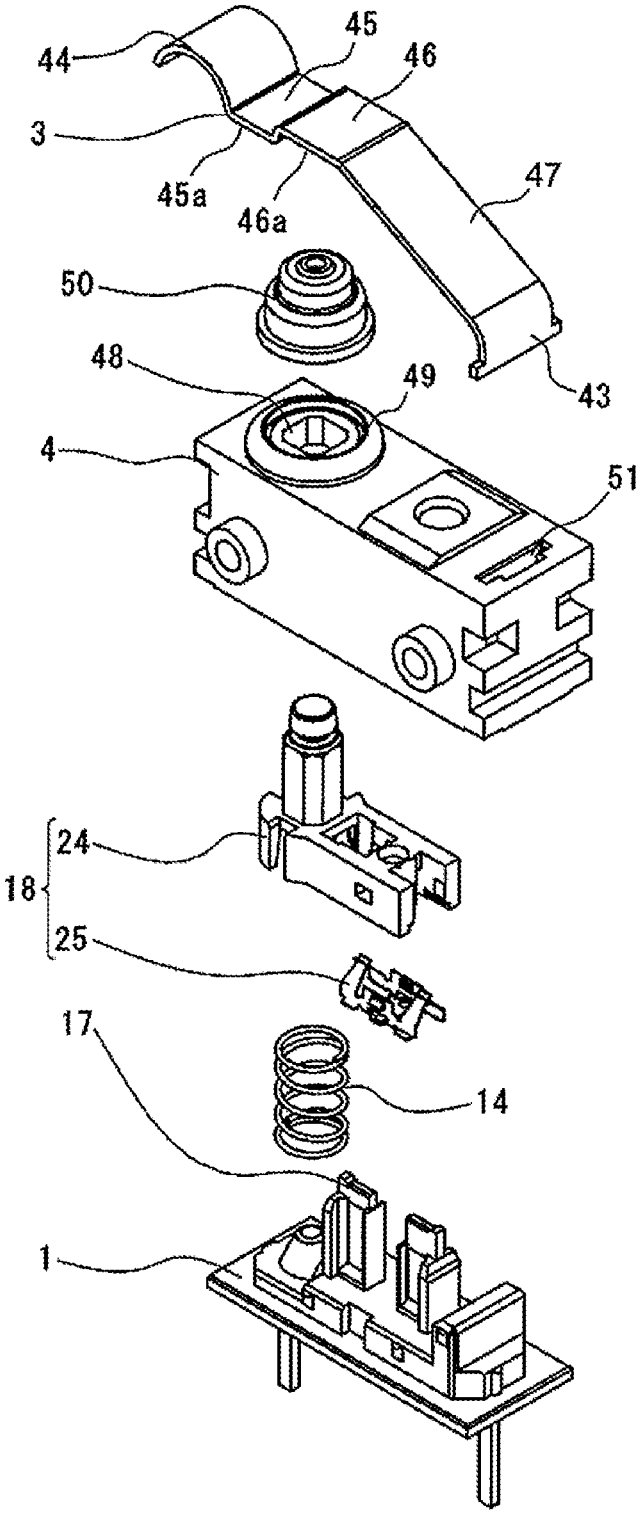
FIG. 2 is an exploded perspective view of FIG. 1.

FIG. 1 is a perspective view of a switch according to a first embodiment, and FIG. 2 is an exploded perspective view thereof. This switch includes a base 1, a contact switching mechanism 2, an operation body 3, and a cover 4.

Figure 3A:
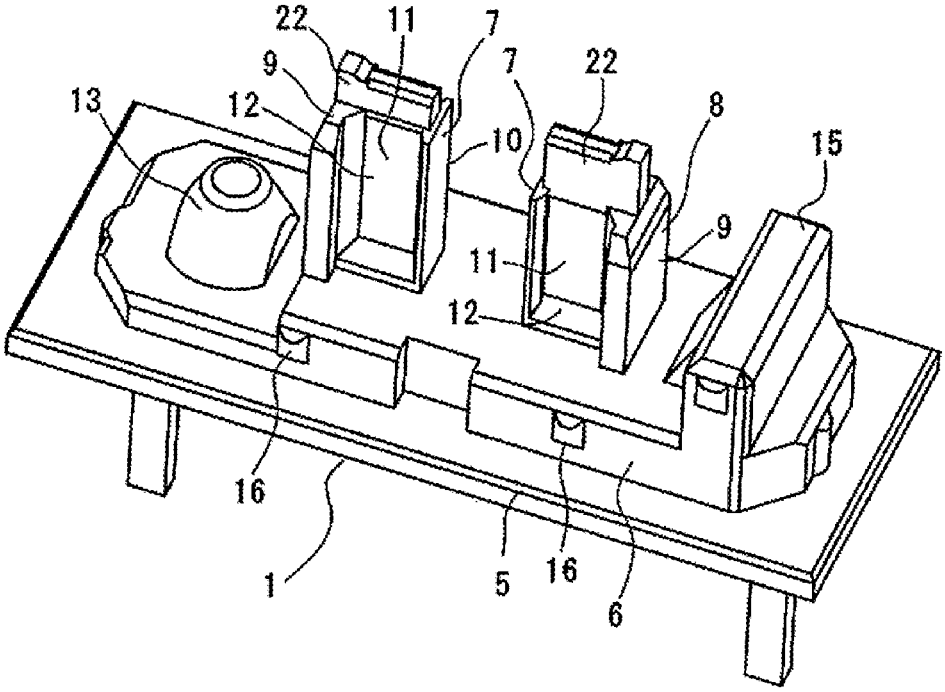
FIG. 3A is a perspective view of the base of FIG. 2.

As illustrated in FIG. 3A, the base 1 is formed, for example, by molding a synthetic resin material and includes a bottom 5 having a rectangular shape in a plan view and a pedestal 6 on the upper surface thereof. A fixed contact member 17 of a contact switching mechanism 2, described later, is insert-molded on the base 1. The pedestal 6 has a rectangular shape in a plan view and is formed inside the base 1.

A first guide 7 and a second guide 8 are formed in the central portion of the pedestal 6 at a predetermined interval in the longitudinal direction. Each of the guides 7, 8 includes a first flat plate 9 formed on the longitudinal end side, a second flat plate 10 disposed at a predetermined interval with the first flat plate 9 on the inside thereof, and a third flat plate 11 connecting the central portions of the first flat plate 9 and the second flat plate 10. By these flat plates, guide grooves 12 extending in the vertical direction are formed on both sides of the first guide 7 and the second guide 8. A movable contact portion 41, described later, slides on the bottom surface (i.e., the side surface extending in the vertical direction) of the guide groove 12.

One end side of the pedestal 6 is lower in height than the other portions, and in the central portion thereof, a frusto-conical first spring receiving portion 13 is formed. A coil spring 14 which is an example of an elastic body is disposed in the first spring receiving portion 13 and energizes a movable contact member 18, described later, upward. At the other end side of the pedestal 6, a guide wall 15 projecting upward is formed.

A pair of guide projections 16 are formed on both side surfaces of the pedestal 6 at a predetermined interval in the longitudinal direction. One guide projection 16 is also formed on each of both end surfaces of the pedestal 6. Further, one guide projection 16 is also formed on each of the upper side portions of the guide wall 15. These guide projections 16 abut on the inner side surface of the cover 4 when the base 1 is covered with the cover 4, and ensure a gap between the outer side surface of the base 1 and the inner side surface of the cover 4.

The contact switching mechanism 2 includes the fixed contact member 17 and the movable contact member 18.

Figure 3B:
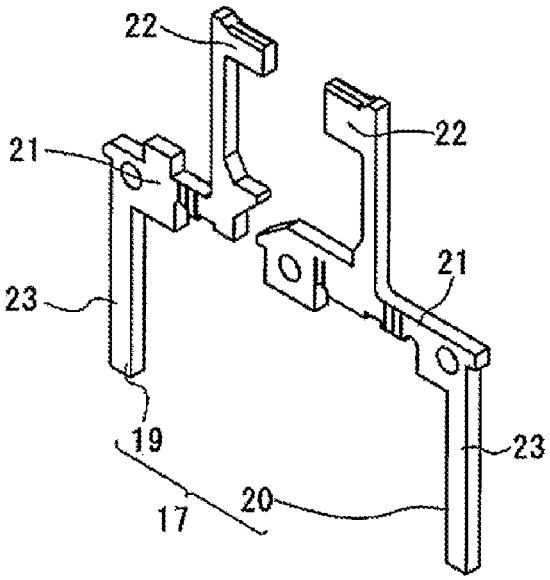
FIG. 3B is a perspective view illustrating a fixed contact terminal of FIG. 3A.

As illustrated in FIG. 3B, the fixed contact member 17 includes a first fixed contact terminal 19 and a second fixed contact terminal 20 which are insert-molded on the base 1. Each fixed contact terminal is obtained by pressing a copper alloy. Each fixed contact terminal includes a supported portion 21. A wide fixed contact portion 22 is formed at a tip of a narrow portion extending upward from the supported portion 21. Further, a fixed terminal portion 23 extends from the supported portion 21 to the side opposite to the fixed contact portion 22.

As illustrated in FIG. 3A, in a state where the fixed contact member 17 is insert-molded on the base 1, the fixed contact portion 22 is exposed from the upper portion of each of the guides 7, 8. Both surfaces of the fixed contact portion 22 are flush with the bottom surface of the guide groove 12. Further, the fixed terminal portion 23 is projected from the lower surface of the base 1.

Figure 4:
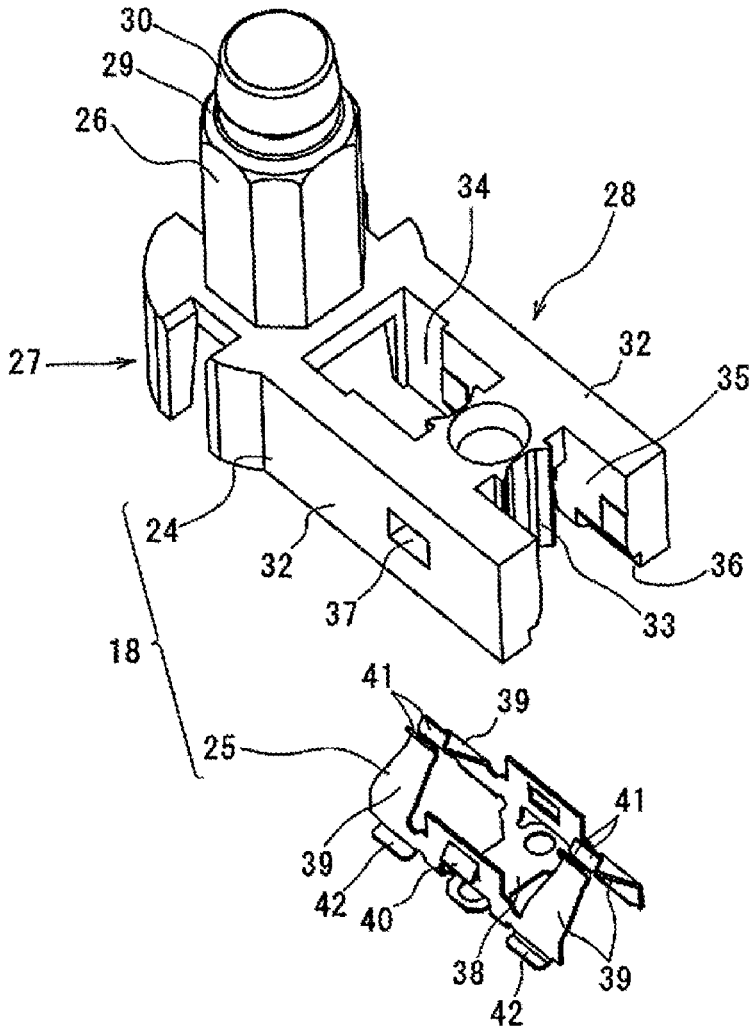
FIG. 4 is an exploded perspective view illustrating a movable contact member of FIG. 2.

As illustrated in FIG. 4, the movable contact member 18 is formed by integrating a movable contact terminal 25 with a movable contact body 24.

The movable contact body 24 is formed, for example, by molding a synthetic resin material, and includes a shaft 26, a second spring receiving portion 27, and a contact receiving portion 28. The shaft 26 has a polygonal cross-sectional shape, and a cylindrical pressed portion 30 is formed at the upper end portion via a thin neck portion 29. The second spring receiving portion 27 has a shape formed by cutting a cylindrical body at three equally spaced places on the circumference into three pieces. A frusto-conical spring guide (not illustrated) is formed on the upper surface of the second spring receiving portion 27. The upper end of the coil spring 14 disposed in the second spring receiving portion 27 of the base 1 is disposed in the second spring receiving portion 27, whereby the movable contact member 18 is energized upward. A contact receiving portion 28 is formed by connecting intermediate portions of guide plates 32, extending at a predetermined interval, with a connector 33. Hence the contact receiving portion 28 is formed with an opening 34 having a rectangular shape in a plan view and a groove 35. A locking recess 36 is formed on the lower edge of each of the guide plates 32 constituting the opening 34 and the groove 35. Further, a locking hole 37 having a rectangular shape in cross section is formed on the side surface of the guide plate 32. The locking hole 37 opens inward below the connector 33.

The movable contact terminal 25 is formed, for example, by pressing a copper alloy and includes a pair of movable pieces 39 connected by a connection plate 38. A locking claw 40 is cut and raised at the central portion of each movable piece 39. Further, from both end of each movable piece 39, movable contact portions 41 and locking pieces 42 projecting laterally from the lower end are formed, respectively, the movable contact portions 41 projecting obliquely upward in the approaching direction and having the tip portions curved and facing each other at a predetermined interval, The movable contact terminal 25 is pressed into the opening 34 and the groove 35 from the lower side with respect to the second spring receiving portion 27 of the movable contact body 24 to lock the locking claw 40 into the locking hole 37 and lock the locking piece 42 into the locking recess 36, so that the movable contact terminal 25 is assembled to the movable contact body 24.

Returning to FIG. 2, the operation body 3 is formed, for example, by pressing a plate-like spring material. One plate surface of the operation body 3 is provided so as to face the cover 4 and one end thereof is curved to be a fixing portion 43 having projections formed on both sides. That is, the operation body 3 is fixed to the cover 4 by inserting the fixing portion 43 into the attachment hole 51 of the cover 4. The other end of the operation body 3 is an operation unit 44 formed in an arc shape in cross section. The operation unit 44 swings in the direction approaching the cover 4 around the fixing portion 43. The operation unit 44, a first presser 45, and a second presser 46 are sequentially formed from the operation unit 44 toward the fixing portion 43. The first presser 45 includes a flat first pressing surface 45*a*. With the fixing portion 43 fixed in the attachment hole 51 of the cover 4, the first pressing surface 45*a* is substantially parallel to the upper surface of the cover 4 and comes into contact with the upper surface of the pressed portion 30 of the movable contact body 24. The second presser 46 is recessed in the direction away from the cover 4 in the movable direction of the operation unit 44 with respect to the first presser 45, and the lower surface is a flat second pressing surface 46*a*. That is, in the operation body 3, the first presser 45 and the second presser 46 are disposed in a step-like manner. The second presser 46 and the fixing portion 43 are connected by an inclined portion 47 which is inclined with respect to the upper surface of the cover 4 so as to approach the cover 4 from the operation unit 44 toward the fixing portion 43.

According to the operation body 3 having the above configuration, when the operation unit 44 is depressed toward the upper surface of the cover 4 with the fixing portion 43 fixed in the attachment hole 51 of the cover 4, the first pressing surface presses the pressed portions 30 of the movable contact member 18. When the movable contact member 18 is depressed, the inclined portion 47 of the operation body 3 is bent, the first presser 45 exceeds the pressed portion 30, and the second presser 46 is positioned above the pressed portion 30. That is, after the movable contact member 18 is depressed, the movable contact member 18 once moves upward and is then depressed again.

The cover 4 is formed, for example, by molding a synthetic resin material and has a box shape with the lower surface opened. One end side of the upper wall of the cover 4 is formed with an insertion hole 48 through which the shaft 26 of the movable contact body 24 is inserted in a vertically movable manner. The insertion hole 48 is formed in a polygonal shape in accordance with the cross-sectional shape of the shaft 26. A guide 49 having an annular groove is formed on the circumference of the insertion hole 48 so that a cap 50 can be attached. The cap 50 is made of a rubber material in a bellows-like manner and is in close contact with the shaft 26 of the movable contact body 24. The cap 50 expands and contracts in accordance with the vertical movement of the movable contact member 18. Thereby, sealability of the insertion hole 48 is ensured. Further, at the other end side of the upper wall of the cover 4, an attachment hole 51 is formed. A fixing portion 43 of the operation body 3 is inserted and fixed into the attachment hole 51.

Subsequently, a method of assembling the switch having the above configuration will be described.

First, the fixed contact member 17 is insert-molded to form the base 1. Further, the movable contact member 18 is obtained by press-fitting and fixing the movable contact terminal 25 to the movable contact body 24. The coil spring 14 is disposed in the first spring receiving portion 13 of the base 1, and the movable contact member 18 is disposed in the first guide 7 and the second guide 8 of the base 1. In the movable contact member 18, the first guide 7 and the second guide 8 are respectively inserted into the opening 34 and the groove 35. At this time, grease is previously applied to the outer surfaces of the first guide 7 and the second guide 8 so that the movable contact member 18 can be moved smoothly.

Subsequently, the cover 4 is attached to the base 1. At this time, the movable contact member 18 is depressed to the lower surface of the upper wall of the cover 4 so that the movable contact portion 41 comes into pressure contact with the fixed contact portion 22, or the shaft 26 of the movable contact member 18 is inserted through the insertion hole 48 of the cover 4 to project upward.

Finally, the cap 50 is mounted on the shaft 26 projecting from the upper surface of the cover 4, and the fixing portion 43 of the operation body 3 is inserted and fixed into the attachment hole 51 of the cover 4, to complete the switch.

Next, the operation of the switch having the above configuration will be described.

Figure 5A:
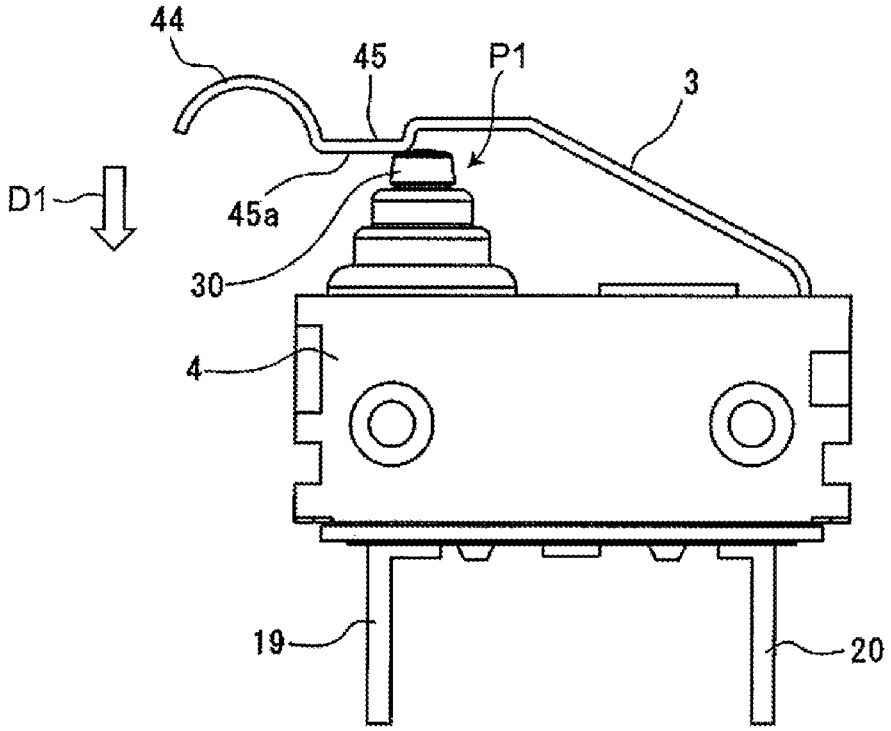
FIG. 5A is a front view illustrating the operation of the switch illustrated in FIG. 1.

In an initial state where the operation body 3 is not operated, as illustrated in FIG. 5A, the movable contact member 18 moves upward by the energizing force of the coil spring 14 and abuts on the lower surface of the upper wall of the cover 4. In the initial state, the movable contact portion 41 is in contact with the fixed contact portion 22 and the fixed contact members 17 are in a conductive state.

When the operation unit 44 of the operation body 3 is pressed, the first presser 45 moves downward (an example of a first direction D1) while the inclined portion 47 is elastically deformed. Thereby, the first pressing surface 45*a* depresses the pressed portion 30 of the movable contact member 18, and the movable contact member 18 moves downward. The movable contact portions 41 separate from the fixed contact portions 22 and reach the side surfaces of the first guide 7 and the second guide 8. That is, the conductive state between the fixed contact members 17 is cut off. The downward movement of the movable contact member 18 continues to a first position P1 which is the lowermost position where the pressing by the first pressing surface 45*a* continues.

Figure 5B:
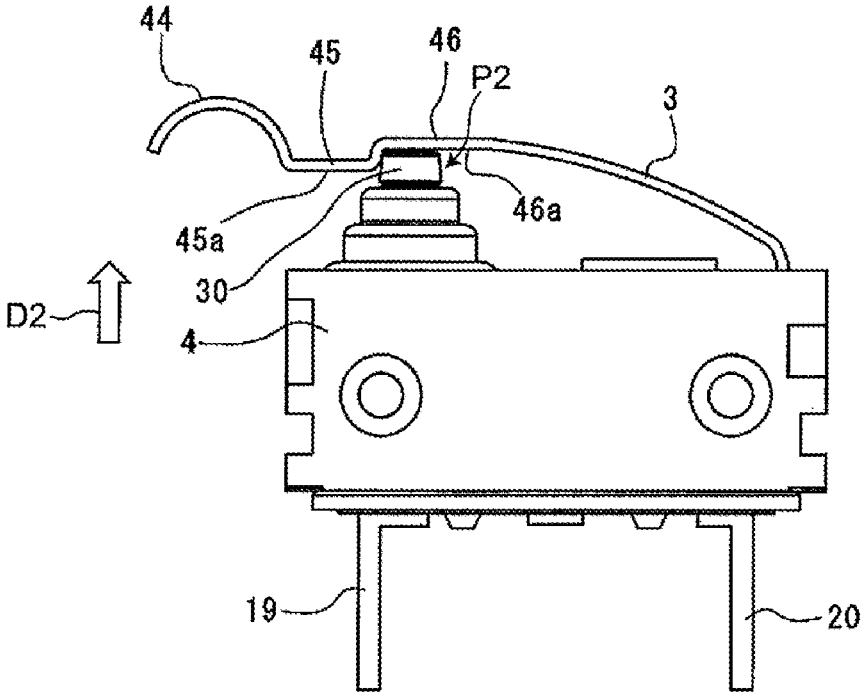
FIG. 5B is a front view illustrating the operation of the switch illustrated in FIG. 1.

Then, when the operation unit 44 is further pressed beyond the first position P1 where the movable contact member 18 has been depressed most by the first pressing surface 45*a*, the first pressing surface 45*a* moves to the front (left side in FIG. 5A) beyond the pressed portion 30 due to the elastic deformation of the movable contact member 18. Thereby, the pressing of the movable contact member 18 against the pressed portion 30 by the first pressing surface 45*a* is released, and the pressed portion 30 once moves upward (an example of a second direction D2) by the energizing force of the coil spring 14. Then, as illustrated in FIG. 5B, the pressed portion 30 of the movable contact member 18 moves to a second position P2 above the first position P1 where the pressed portion 30 abuts on the first pressing surface 45*a*.

Figure 5C:
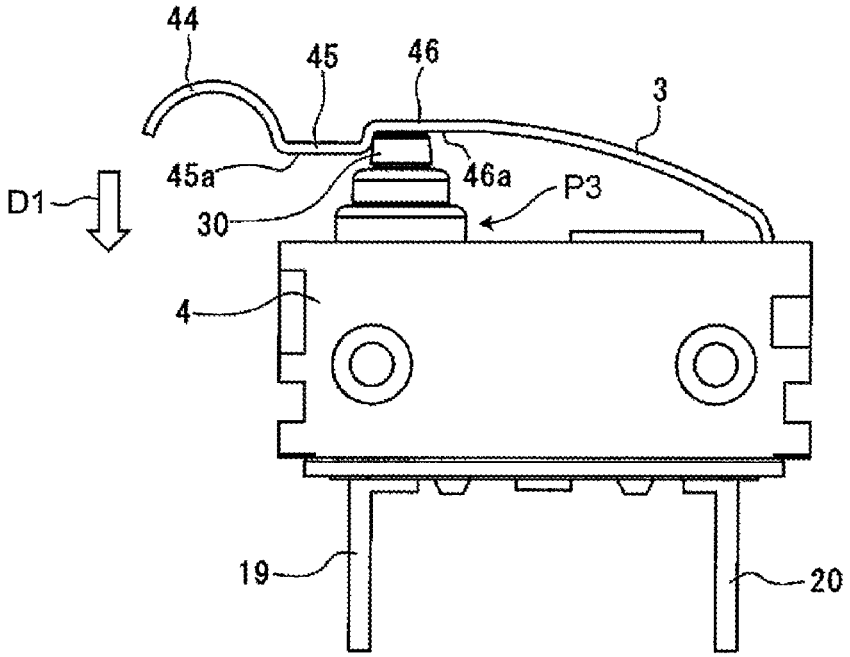
FIG. 5C is a front view illustrating the operation of the switch illustrated in FIG. 1.

Thereafter, when the pressing operation of the operation unit 44 is further continued, the pressed portion 30 of the movable contact member 18 is depressed by the second pressing surface 46*a*, and as illustrated in FIG. 5C, the pressed portion 30 reaches a third position P3 before the first position P1 from the second position P2. The pressing operation of the operation unit 44 ends at the third position P3. Then, the non-conductive state between the fixed contact members 17 is maintained until the movable contact member 18 moves from the first position P1 to the third position P3.

Meanwhile, in the switch having the above configuration, the use thereof may cause the occurrence of the grease accumulation at the lower end of each of the guides 7, 8, which is at the same position as the first position P1 or is away from the initial position than the first position P1 in the direction of the movement of the movable contact member 18 by the pressing operation of the operation body 3. Then, abrasion powder generated from the contact caused by the long-term use may be mixed into the grease accumulation to increase the viscosity, and the grease accumulation may spread upward due to the pulling by the moving movable contact member 18 or the wettability of the grease itself.

Figure 6:
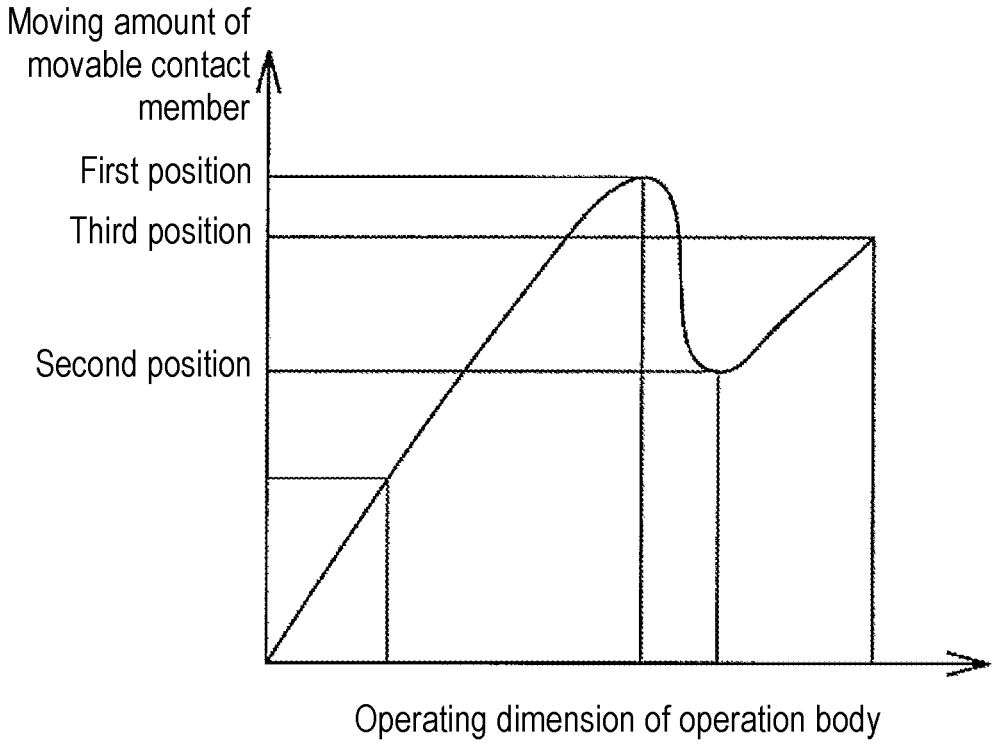
FIG. 6 is a graph illustrating the relationship between the operating dimension of the operation body illustrated in FIG. 1 and the moving amount of the movable contact member.

According to the switch having the above configuration, as illustrated in FIG. 6, by the pressing operation of the operation body 3, the movable contact member 18 can be once moved instantaneously from the first position P1, where the movable contact member 18 has been moved to the lowermost side, to the upper second position P2 by the energizing force of the coil spring 14. Therefore, even if the grease accumulation spreads upward, the contacts remain in the closed state only after the movable contact member 18 moves from the lowermost first position P1 to the second position P2 above the first position P1. That is, as compared to a switch including a movable contact member that moves only in the same direction in accordance with the pressing operation of the operation body, the stroke of the movable contact member 18 by the pressing operation of the operation body 3 can be made smaller. Thus, even if the grease accumulation occurs at the lower end of each of the guides 7, 8, the movable contact member 18 moves only to the third position P3 which is an intermediate position between the position P1 and the second position P2 via the second position P2 closer to the initial position than the first position P1 is in the movement direction of the movable contact member 18. As a result, the position of the movable contact member 18 when the operation body 3 is pressed can be restricted to the position away from the grease accumulation. This can make the movable contact member 18 less susceptible to the adverse effect of the grease accumulation to ensure the desired contact reliability of the contacts.

Second Embodiment

Figure 7:
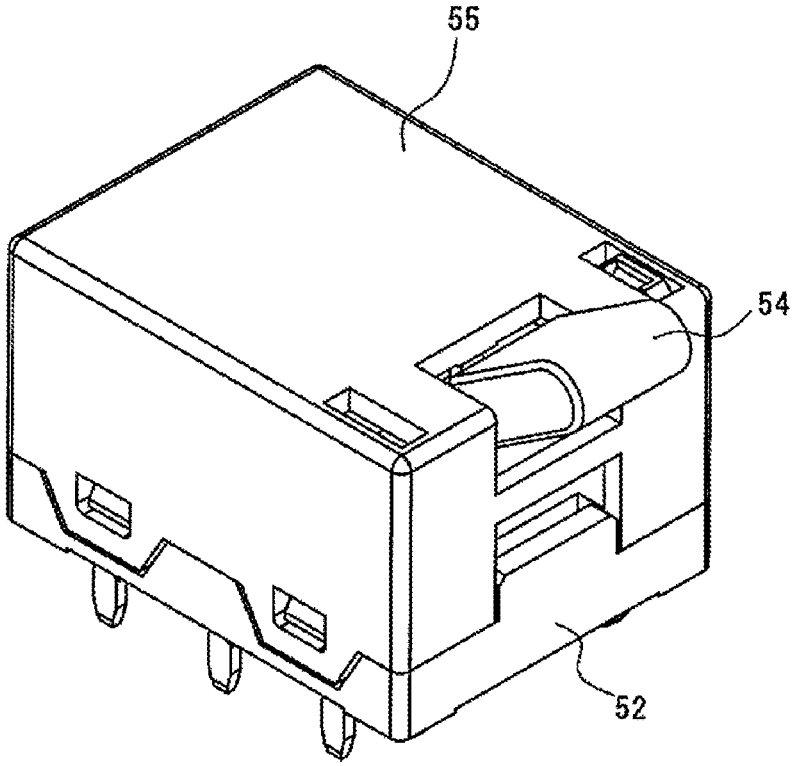
FIG. 7 illustrates a perspective view of a switch according to a second embodiment.
Figure 8:
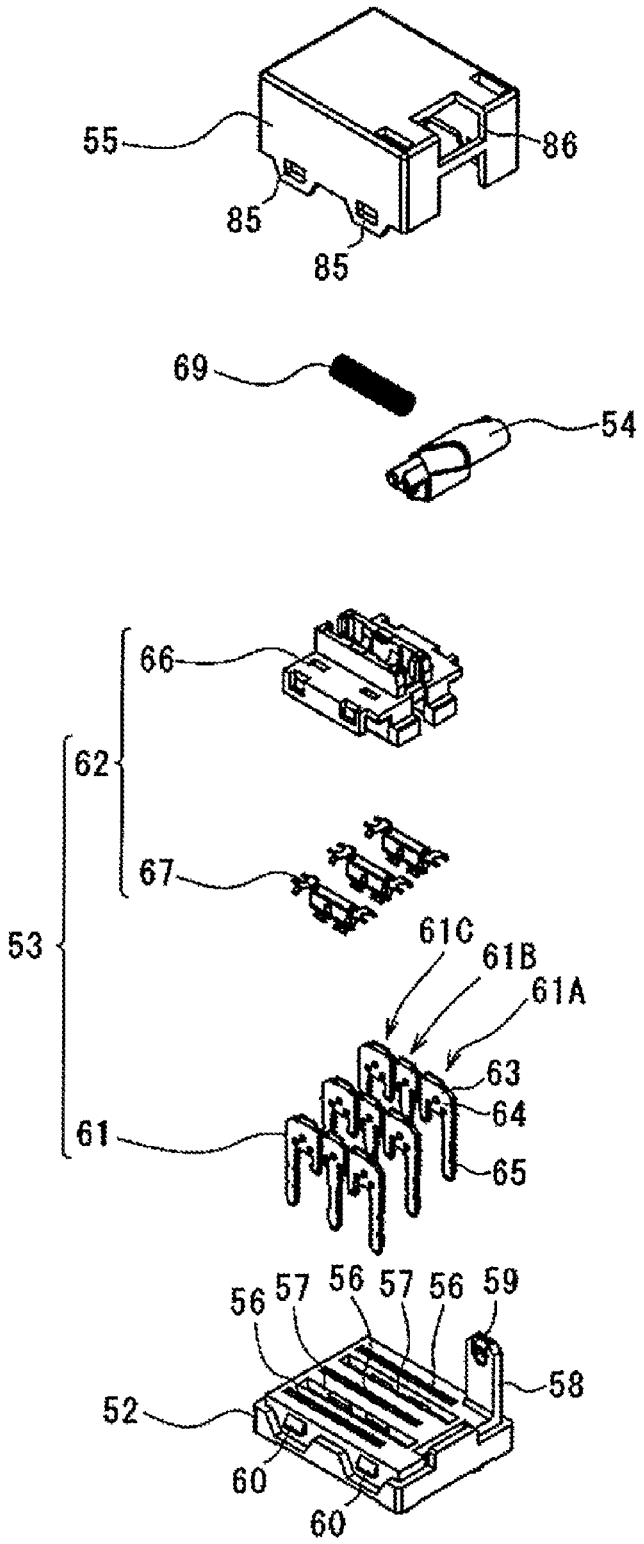
FIG. 8 is an exploded perspective view of FIG. 7.

FIG. 7 is a perspective view of a switch according to a second embodiment, and FIG. 8 is an exploded perspective view thereof. The switch includes a base 52, a contact switching mechanism 53, an operation body 54, and a cover 55.

The base 52 is formed by molding a synthetic resin material, and terminal holes 56 are formed at three places in each of three rows. Support recesses 57 are formed at two places between the rows of the terminal holes 56, respectively. Support plates 58 project upward (one is not illustrated) from both sides of one end of the base 1 and bearing holes 59 are formed at the tips thereof. A pair of locking claws 60 are formed on each side of the base 1.

The contact switching mechanism 53 includes a fixed contact member 61 and a movable contact member 62.

The fixed contact member 61 is formed, for example, by pressing a plate-like copper alloy, and includes an upper fixed contact portion 63, a supported portion 64 having a plurality of projections formed on the side surface, and a fixed terminal portion 65 extending downward from the supported portion 64. A first fixed contact member 61A, a second fixed contact member 61B, and a third fixed contact member 61C are assembled in one row as one set, and these are mounted in three rows in the base 52.

Figure 9:
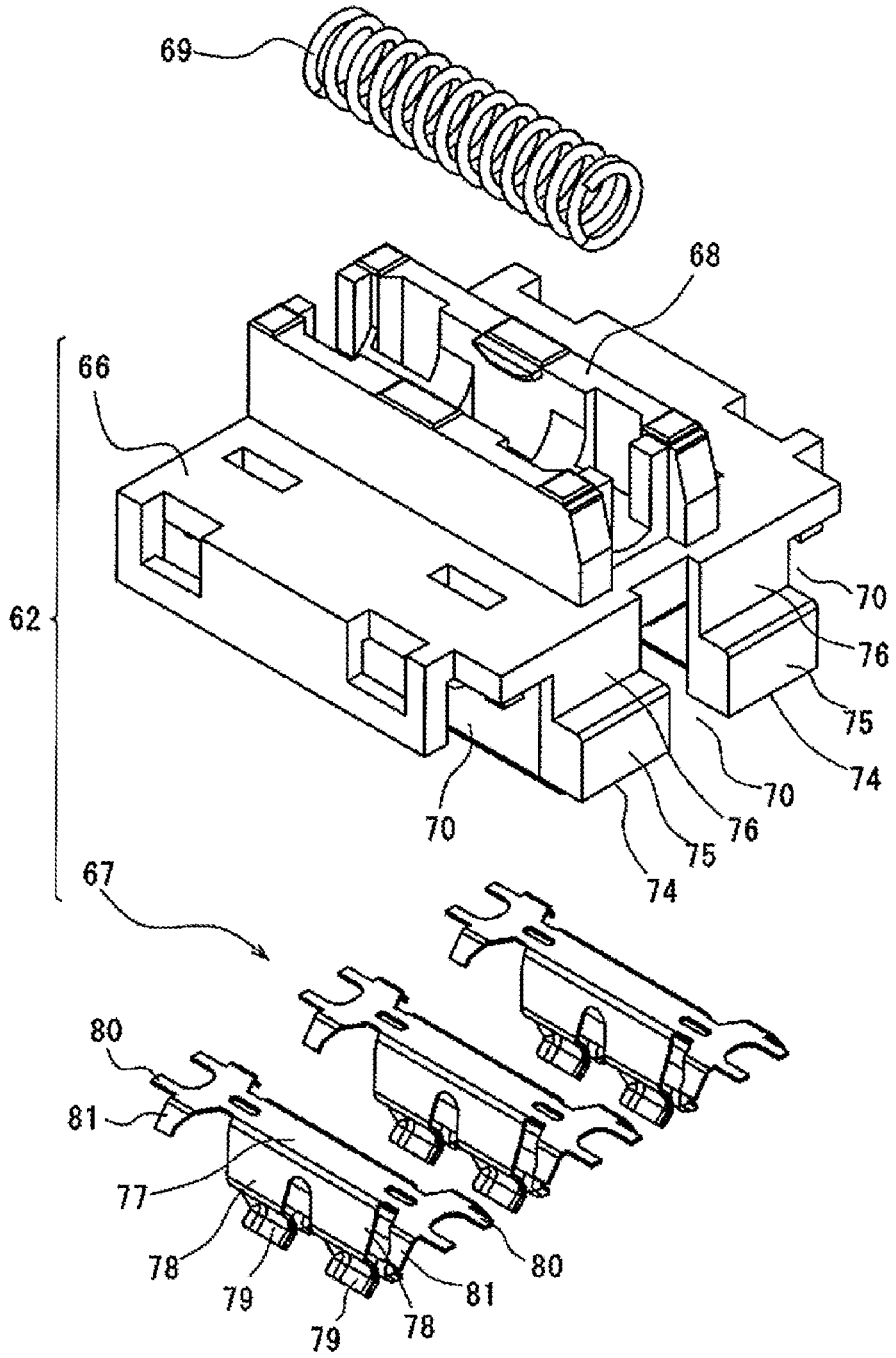
FIG. 9 is an exploded perspective view of the movable contact member of FIG. 8.

As illustrated in FIG. 9, the movable contact member 62 is formed by integrating a movable contact terminal 67 with a movable contact body 66.

Figure 10:
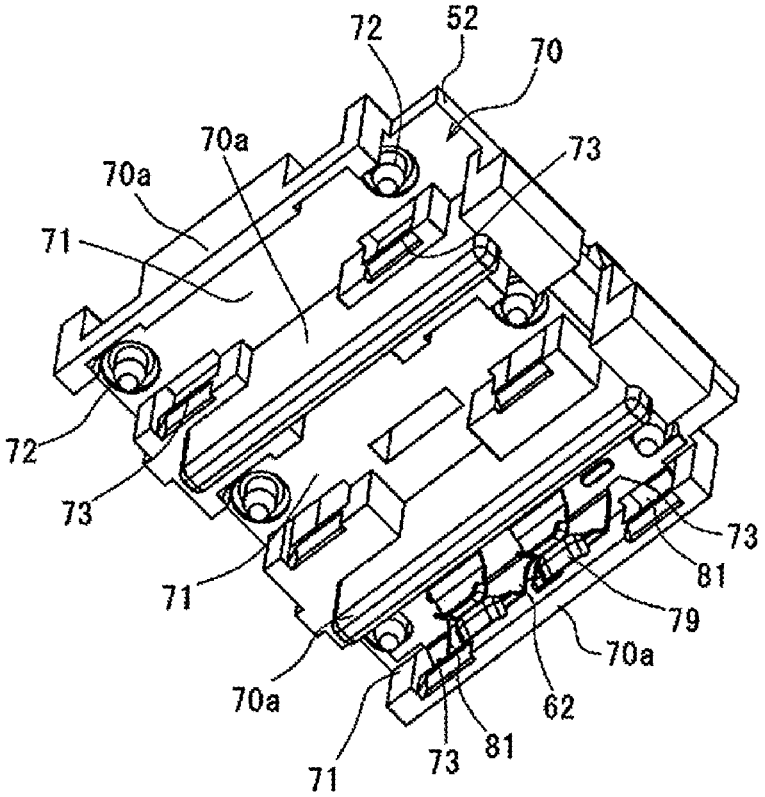
FIG. 10 is a perspective view of the movable contact body of FIG. 9 as viewed from below.

The movable contact body 66 is formed, for example, by molding a synthetic resin material, and a spring guide 68 is formed at the central portion of the upper surface of the flat plate. The spring guide 68 has side walls formed at a predetermined interval and can be mounted with a coil spring 69 from above. Further, on the lower surface of the movable contact body 24, a contact receiving portion 70 for attaching the movable contact terminal 67 is formed. As illustrated in FIG. 10, the contact receiving portion 70 is made up of three housing portions 71 divided by four side walls 70*a*. Guide protrusions 72 are formed at a predetermined interval on the lower surface of the flat plate that constitutes a part of the housing portion 71, and locking recesses 73 are formed on the facing surfaces of the side walls. The movable contact terminal 67 can be mounted in the housing portion 71. Further, on one end surface of the movable contact body 66, a pressed portion 74 projecting in a step-like manner is formed. The pressed portion 74 includes a first pressed surface 75 (an example of a first pressed portion) on the lower side projecting from the end face, and a second pressed surface 76 (an example of a second pressed portion) flush with the end face positioned on the upper side of the first pressed surface 75. The pressed portion 74 is pressed by a presser of the operation body 54 described later.

Returning to FIG. 9, the movable contact terminal 67 is formed, for example, by pressing a plate-like copper alloy and includes two pairs of movable pieces 78 facing each other and extending downward from both sides of a connection plate 77. The movable pieces 78 in each set are gradually inclined downward in the separating direction and then approach each other, and each of the lower end portions is a movable contact portion 79 having an arc-shaped cross section. Further, each end of the movable contact terminal 67 is formed with a U-shaped guide 80 extending in the direction to each end, and a locking piece 81 extending obliquely downward.

The movable contact member 62 having the above configuration is placed on the base 52 to bring the movable pieces 78 of the movable contact terminal 67 into the state of holding the fixed contact portion 63 of the fixed contact terminal. In this state, the movable contact member 62 can linearly reciprocate along the row in which the fixed contact portion 63 is exposed.

Figure 11:
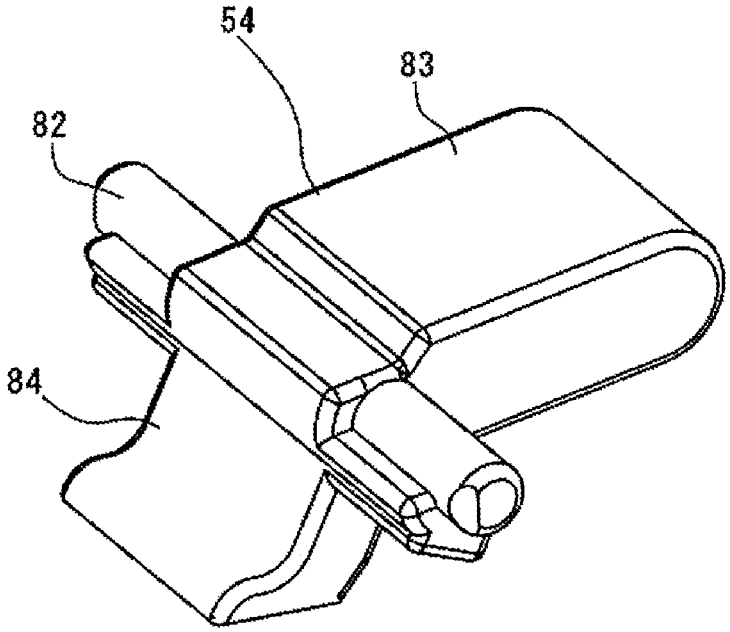
FIG. 11 is a perspective view illustrating the operation body of FIG. 8.

As illustrated in FIG. 11, the operation body 54 includes a shaft 82 rotatably supported in the bearing hole 59 formed in the support plate 58 of the base 52. An operation unit 83 extends from the shaft 82 and projects to the outside through an opening 86 of the cover 55. Further, the drive portion 84 (an example of the presser) extends from the shaft 82 to the side opposite to the operation unit 83, and the pressed portion 74 of the movable contact member 62 can be pressed.

Returning to FIG. 8, the cover 55 is formed, for example, by molding a synthetic resin material and has a box shape with the lower surface opened. On both sides of the cover 55, locking holes 85 which are respectively locked to the locking claws 60 of the base 52 are formed. Further, an opening 86 is formed on one end side of the cover 55, and the operation unit 83 of the operation body 54 projects so as to be operable through the opening 86. A projected portion (not illustrated) is formed on the lower surface of the upper wall of the cover 55. The projected portion is capable of entering into the spring guide 68 formed in the movable contact body 66.

Subsequently, a method of assembling the switch having the above configuration will be described.

The fixed contact member 61 is press-fit into each terminal hole of the base 52. Thereby, three each of fixed contact portions 63 of the fixed contact member 61 project in each of three rows on the upper surface side of the base 52. In addition, the fixed terminal portion 65 of the fixed contact member 61 projects downward from the lower surface of the base 52.

The movable contact terminals 67 are press-fit into the housing portions 71 formed at three places on the lower surface of the movable contact body 66, respectively. The guide 80 is elastically deformed by simply inserting the movable contact terminal 67 from the lower side into the housing portion 71, and the guide 80 then returns to its shape and is locked to the engagement recess 73, so that the movable contact terminal 67 is attached easily. Further, the coil spring 69 is mounted into the spring guide 68.

The movable contact member 62 obtained in this manner is placed on the base 52 so that the fixed contact portion 63 projecting from the upper surface of the base 52 is held by the movable piece 78. Then, the operation body 54 is attached to the base 52 so that the shaft 82 of the operation body 54 is rotatably supported by the bearing holes 59 formed in the support plate 58 of the base 52.

Finally, the cover 55 is covered with the base 52, and the operation unit 83 of the operation body 3 is projected from the opening 86.

Next, the operation of the switch having the above configuration will be described.

In an initial state where the operation body 54 is not operated, the coil spring 69 is not pressed by the projected portion of the cover 55, and the movable contact member 62 is positioned at the initial position where the movable contact member 62 has moved closest to the opening. Along with this, the operation body 54 is also positioned at the initial position where the operation body 54 projects upward the most. Further, in this state, the movable contact portion 79 contacts the fixed contact portion 63 of the first fixed contact member 61A and the fixed contact portion 63 of the second fixed contact member 61B to electrically connect the first fixed contact member 61A and the second fixed contact member 61B.

Figure 12A:
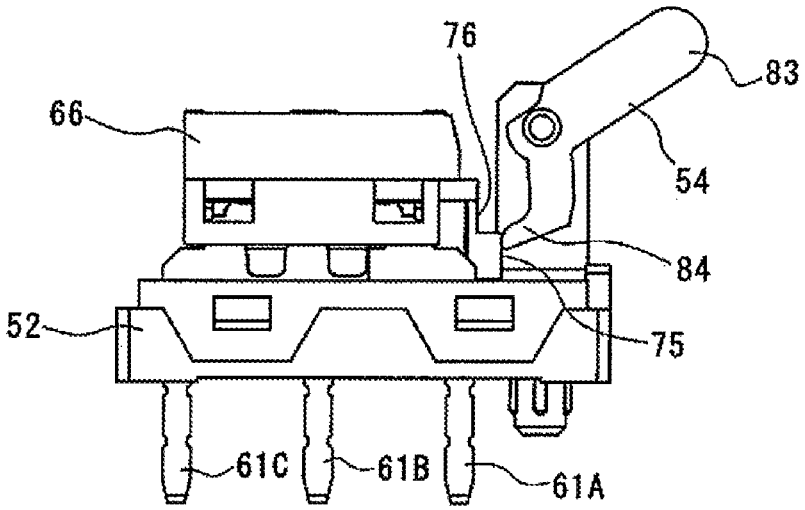
FIG. 12A is a front view illustrating the operation of the switch illustrated in FIG. 7.
Figure 12B:
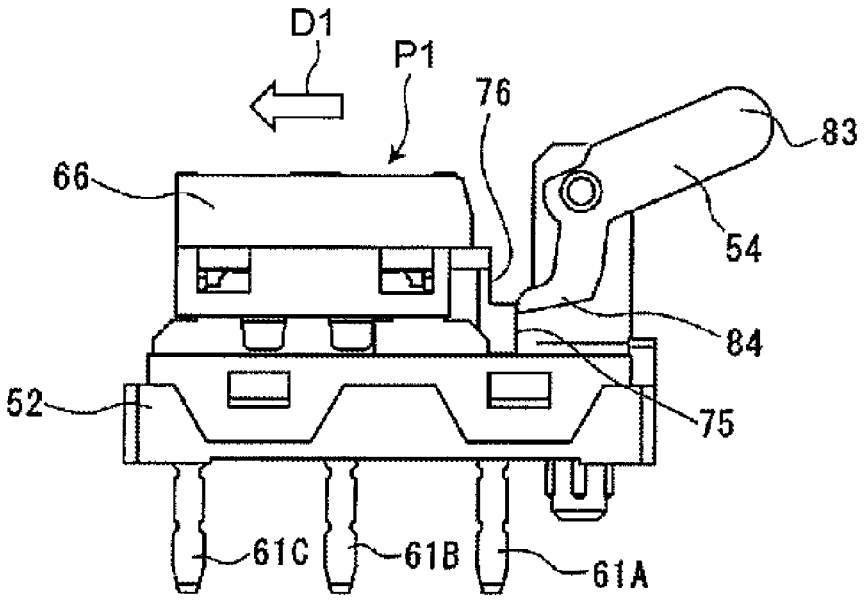
FIG. 12B is a front view illustrating the operation of the switch illustrated in FIG. 7.

In this state, when the operation unit 83 of the operation body 54 is depressed, the operation body 54 rotates clockwise in FIG. 12A about the shaft 82 to first press the first pressed surface 75 of the movable contact member 62 with the drive portion 84. Thereby, the movable contact member 62 moves leftward (an example of a first direction D1) from the initial position. The locus of the drive portion 84 of the operation body 54, specifically, the locus of the position of the first pressed surface 75 pressed by the drive portion 84, is a circular arc gradually going upward while going leftward. Therefore, while the drive portion 84 is positioned on the first pressed surface 75, the movable contact member 62 is pushed leftward to move to a first position P1 which is the largest leftward movement position as illustrated in FIG. 12B. At this time, the movable contact portion 79 separates from the fixed contact portion 63 of the first fixed contact member 61A and comes into contact with the fixed contact portion 63 of the second fixed contact member 61B and the fixed contact portion 63 of the third fixed contact member 61C to electrically connect the second fixed contact member 61B and the third fixed contact member 61C.

Figure 12C:
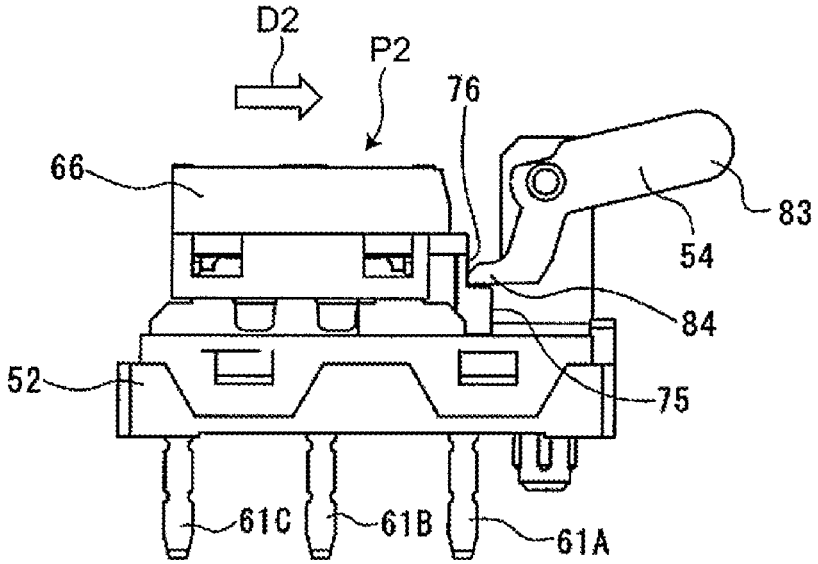
FIG. 12C is a front view illustrating the operation of the switch illustrated in FIG. 7.

Subsequently, when the operation unit 83 of the operation body 54 is pressed, the drive portion 84 deviates from the first pressed surface 75 and moves to above the first pressed surface 75. At this time, the coil spring 69 is compressed by the projected portion of the cover 55. Thereby, the movable contact member 62 loses the support by the drive portion 84 on the first pressed surface 75. By the energizing force of the coil spring 69, as illustrated in FIG. 12C, the movable contact member 62 temporarily moves rightward (an example of a second direction D2) from the first position P1 and moves to a second position P2 where the drive portion 84 abuts on the second pressed surface 76. That is, regardless of the pressing operation of the operation unit 83, the movable contact member 62 converts the moving direction from the left to the right.

When the operation unit 83 of the operation body 54 is further pressed, the drive portion 84 presses the second pressed surface 76 recessed leftward (i.e., the first direction D1) with respect to the first pressed surface 75, and the movable contact member 62 moves leftward again and moves to a third position (not illustrated) before the first position P1 (i.e., in the second embodiment, the first direction D1 constitutes the pressing direction of the movable contact member 62). The conductive state of the second fixed contact member 61B and the third fixed contact member 61C is maintained until the movable contact member 62 moves from the first position P1 to the third position (not illustrated).

As described above, according to the switch having the above configuration, by the pressing operation of the operation body 54, the movable contact member 62 can be once moved instantaneously from the first position P1, where the movable contact member 62 has been moved to the leftmost side, to the second position P2 on the right by the energizing force of the coil spring 69. That is, as compared to the switch including a movable contact member that moves only in the same direction in accordance with the pressing operation of the operation body, the stroke of the movable contact member 62 by the pressing operation of the operation body 54 can be made smaller. Thus, even if the grease accumulation occurs at the lower end of each guide 80, the movable contact member 62 moves only to the third position (not illustrated) which is an intermediate position between the position P1 and the second position P2 via the second position P2 closer to the initial position than the first position P1 is in the movement direction of the movable contact member 62. As a result, the position of the movable contact member 62 when the operation body 54 is pressed can be regulated to a position away from the grease accumulation. Therefore, as in the first embodiment, the movable contact member 62 is not adversely affected by the grease accumulation, and the contact reliability of the contact is not impaired.

Note that the present disclosure is not limited to the configuration described in the above embodiment, and various modifications are possible.

In the embodiment described above, the coil springs 14 and 69 are used as elastic bodies, but elastic bodies of other materials such as sponge, rubber, etc., or elastic bodies having different shapes may be used.

Various embodiments of the present disclosure have been described in detail with reference to the drawings, and lastly, various aspects of the present disclosure will be described. In the following description, as an example, a reference symbol is also attached.

A switch of a first aspect of the present disclosure is a switch including: a base 1, 52; a fixed contact member 17, 61 having a fixed contact 22, 63 and provided on the base 1, 52; a movable contact member 18, 62 having a movable contact 41, 79 and configured to bring the movable contact 41, 79 into contact with the fixed contact 22, 63 by moving in a first direction D1, the movable contact member 18, 62 being configured to separate the movable contact 41, 79 from the fixed contact 22, 63 by moving in a second direction D2 opposite to the first direction D1; an elastic body 14, 69 configured to energize the movable contact member 18, 62 in the second direction D2; a cover 4, 55 attached to the base 1, 52 and configured to cover the fixed contact member 17, 61 and the movable contact member 18, 62; and an operation body 3, 54 attached to the cover 4, 55 and configured to move the movable contact member 18, 62. The operation body 3, 54 is configured to move the movable contact member 18, 62 sequentially to a first position P1 to which the movable contact member 18, 62 is moved from an initial position in the first direction D1 to bring the movable contact 41, 79 into contact with the fixed contact 22, 63, a second position P2 to which the movable contact member 18, 62 is moved from the first position P1 in the second direction D2 while the movable contact 41, 79 and the fixed contact 22, 63 are kept in contact, and a third position P3 to which the movable contact member 18, 62 is moved again from the second position P2 in the first direction D1, the third position located between the first position P1 and the second position P2.

According to the switch of the first aspect, the operation body 3, 54 moves the movable contact member sequentially to the first position P1, the second position P2, and the third position P3. That is, each of the movable contact members 18, 62 immediately moves to the second position P2 without staying at the first position P1 where the movable contact member has moved the most. For this reason, even if abrasion powder accompanying the contact switching is mixed into the grease accumulation to increase the viscosity and the grease accumulation spreads, each of the movable contact members 18, 62 having moved to the second position P2 and the third position P3 is less susceptible thereto. As a result, the desired contact reliability of the contact can be ensured.

In a switch of a second aspect of the present disclosure, the movable contact member 18 has a pressed portion 30 projecting outside of the cover 4 so as to be pressable, and the operation body 3 extends from one end to the other end, is disposed outside the cover 4, is fixed to the cover 4 at one end side, and has an operation unit 44 on the other end side, the operation body 3 pressing the pressed portion 30 to move the movable contact member 18 sequentially to the first position P1, the second position P2, and the third position P3.

According to the switch of the second aspect, the operation unit 44 of the operation body 3 can move the movable contact member 18 to a desired position.

A switch of a third aspect of the present disclosure further includes an elastic body 14 configured to energize the movable contact member 18 in a direction in which the pressed portion 30 projects from the cover 4. The operation body 3 includes a first presser 45 configured to move the movable contact member 18 from the initial position to the first position P1 by pressing the pressed portion 30, and a second presser 46 configured to move the operation body 3 from the first position P1 to the second position P2 in accordance with an energizing force of the elastic body 14 by releasing a pressed state of the pressed portion 30, and then move the operation body 3 from the second position P2 to the third position P3 by pressing the pressed portion 30.

According to the switch of the third aspect, the position where the pressed portion 30 of the movable contact member 18 is pressed is changed from the first presser 45 to the second presser 46, so that the movable contact member 18 can be moved to a desired position.

A switch of a fourth aspect of the present disclosure further includes an elastic body 69 configured to energize the movable contact member 62 in the second direction. The operation body 54 includes an operation unit 83 on one end side, rotatably attached to the cover 55 about a shaft and positioned outside the cover 55, and a presser 84 on the other end side, configured to press the movable contact member 62 in the first direction D1. The movable contact member 62 includes a first pressed portion 75 configured to move the movable contact member 62 to the first position P1 in a middle of a locus along which the presser 84 moves in a pressing direction of the movable contact member 62, and a second pressed portion 76 configured to move the movable contact member 62 from the second position P2 to the third position after the movable contact member 62 is moved from the first position P1 to the second position P2 in accordance with the energizing force of the elastic body 69 (i.e., configured to move the movable contact member 62 from the second position P2 to the third position after the movable contact member 62 moves from the first position P1 to the second position P2 in accordance with the energizing force of the elastic body 69.

In a switch of a fifth aspect of the present disclosure, the first pressed portion 75 includes a first pressed surface 75 intersecting with the pressing direction, and the second pressed portion 76 includes a second pressed surface 76 continuous with the first pressed surface 75 and recessed in the pressing direction more than the first pressed surface 75 is.

According to the switches of the fourth aspect and the fifth aspect, with a simple configuration formed by simply making the operation body 54 rotatable and forming the first pressed portion (i.e., the first pressed surface) 75 and the second pressed portion (i.e., the second pressed surface) 76 in the movable contact member 62, it is possible to move the movable contact member 62 to a desired position.

By appropriately combining freely selected embodiments or modified examples of the above variety of embodiments or modified examples, the respective effects of those combined can be exerted. While it is possible to combine embodiments, combine examples, or combine an embodiment and an example, it is also possible to combine features in different embodiments or examples.

While the present disclosure has been fully described in connection with the preferred embodiments with reference to the accompanying drawings, various modified examples or corrections will be apparent to those skilled in the art. Such modifications or amendments are to be understood as being included in the scope of the present disclosure according to the appended claims so long as not deviating therefrom.

INDUSTRIAL APPLICABILITY

The switch according to the present disclosure can be used, for example, to detect a locked or unlocked state of a door with an on-vehicle door lock device.

DESCRIPTION OF SYMBOLS

1 base
2 contact switching mechanism
3 operation body
4 cover
5 bottom
6 pedestal
7 first guide

8 second guide
9 first flat plate
10 second flat plate
11 third flat plate
12 guide groove
13 first spring receiving portion
14 coil spring (example of elastic body)
15 guide wall
16 guide projection
17 fixed contact member
18 movable contact member
19 first fixed contact terminal
20 second fixed contact terminal
21 supported portion
22 fixed contact portion (example of fixed contact)
23 fixed terminal portion
24 movable contact body
25 movable contact terminal
26 shaft
27 second spring receiving portion
28 contact receiving portion
29 thin neck portion
30 pressed portion
32 guide plate
33 connector
34 opening
35 groove
36 locking recess
37 locking hole
38 connection plate
39 movable piece
40 locking claw
41 movable contact portion (example of movable contact)
42 locking piece
43 fixed portion
44 operation unit
45 first presser
45*a* first pressing surface
46 second presser
46*a* second pressing surface
47 inclined portion
48 insertion hole
49 guide
50 cap
51 attachment hole
52 base
53 contact switching mechanism
54 operation body
55 cover
56 terminal hole
57 support recess
58 support plate
59 bearing hole
60 locking claw
61 fixed contact member
62 movable contact member
63 fixed contact portion (example of fixed contact)
64 supported portion
65 fixed terminal portion
66 movable contact body
67 movable contact terminal
68 spring guide
69 coil spring (example of elastic body)
70 contact receiving portion
71 housing portion
72 guide protrusion
73 locking recess
74 pressed portion
75 first pressed surface
76 second pressed surface
77 connection plate
78 movable piece
79 movable contact portion (example of movable contact)
80 guide
81 locking piece
82 shaft
83 operation unit
84 drive portion
85 locking hole
86 opening
D1 first direction
D2 second direction
P1 first position
P2 second position
P3 third position

The invention claimed is:

1. A switch comprising:

a base;

a fixed contact member having a fixed contact and provided on the base;

a movable contact member having a movable contact and configured to bring the movable contact into contact with the fixed contact by moving in a first direction, the movable contact member being configured to separate the movable contact from the fixed contact by moving in a second direction opposite to the first direction;

an elastic body configured to energize the movable contact member in the second direction;

a cover attached to the base and configured to cover the fixed contact member and the movable contact member; and an operation body attached to the cover and configured to move the movable contact member, wherein the operation body is configured to move the movable contact member sequentially to a first position to which the movable contact member is moved from an initial position in the first direction to bring the movable contact into contact with the fixed contact, a second position to which the movable contact member is moved from the first position in the second direction while the movable contact and the fixed contact are kept in contact, and a third position to which the movable contact member is moved again from the second position in the first direction, the third position located between the first position and the second position.

2. The switch according to claim 1, wherein the movable contact member has a pressed portion projecting outside of the cover so as to be pressable, and the operation body extends from one end to the other end, is disposed outside the cover, is fixed to the cover at one end side, and has an operation unit on the other end side, the operation body pressing the pressed portion to move the movable contact member sequentially to the first position, the second position, and the third position.

3. The switch according to claim 2, wherein the operation body includes:

a first presser configured to move the movable contact member from the initial position to the first position by pressing the pressed portion, and a second presser configured to move the operation body from the first position to the second position in accordance with an energizing force of the elastic body by releasing a pressed state of the pressed portion, and then move the operation body from the second position to the third position by pressing the pressed portion.

4. The switch according to claim 1, wherein the operation body includes:

an operation unit on one end side, rotatably attached to the cover about a shaft and positioned outside the cover, and a presser on the other end side, configured to press the movable contact member in the first direction, and the movable contact member includes:

a first pressed portion configured to move the movable contact member to the first position in a middle of a locus along which the presser moves in a pressing direction of the movable contact member, and a second pressed portion configured to move the movable contact member from the second position to the third position after the movable contact member moves from the first position to the second position in accordance with the energizing force of the elastic body.

5. The switch according to claim 4, wherein the first pressed portion includes a first pressed surface intersecting with the pressing direction, and the second pressed portion includes a second pressed surface continuous with the first pressed surface and recessed in the pressing direction more than the first pressed surface is.

* * * * *